US005669796A

United States Patent [19]

Harford

[11] Patent Number: 5,669,796

[45] Date of Patent: Sep. 23, 1997

[54] GEOGRID COMPOSED OF POLYETHYLENE TEREPHTHALATE AND POLYOLEFIN BICOMPONENT FIBERS

[75] Inventor: Debra W. Harford, Lincolnton, N.C.

[73] Assignee: Hoechst Celanese Corporation, Somerville, N.J.

[21] Appl. No.: 556,779

[22] Filed: Nov. 2, 1995

[51] Int. Cl.[6] ..... B32B 7/00

[52] U.S. Cl. ..... 442/220; 442/314

[58] Field of Search ..... 428/253, 244, 428/373; 442/220, 314

[56] References Cited

U.S. PATENT DOCUMENTS

| | | | |
|---|---|---|---|
| 3,616,183 | 10/1971 | Brayford et al. . | |
| 4,085,182 | 4/1978 | Kato | 264/171 |
| 4,473,617 | 9/1984 | van Leeuwen et al. | 428/373 |
| 4,756,969 | 7/1988 | Takeda | 428/372 |
| 5,202,185 | 4/1993 | Samuelson | 428/373 |

FOREIGN PATENT DOCUMENTS 42 06 997 9/1993 European Pat. Off. .

OTHER PUBLICATIONS

"Fibers, Manufacture", Encyclopedia of Polymer Science and Engineering vol., 6, pp. 805–811, John Wiley & Sons, New York (1985).

JP 06 212564 *Abstract*.

JP 05 185546 *Abstract*.

*Primary Examiner*—James J. Bell

*Attorney, Agent, or Firm*—Philip P. McCann

[57] ABSTRACT

This invention claims a warp knit, weft inserted geogrid fabric without a topcoat, comprising a bicomponent fiber having filaments each with a sheath of a polyolefin material and about 0.5 to about 2 weight percent carbon black and a core of polyethylene terephthalate.

7 Claims, No Drawings

GEOGRID COMPOSED OF POLYETHYLENE TEREPHTHALATE AND POLYOLEFIN BICOMPONENT FIBERS

FIELD OF THE INVENTION

This invention claims a warp knit, weft inserted geogrid fabric without a topcoat comprising a bicomponent fiber having filaments each with a sheath of a polyolefin material and about 0.5 to about 2 weight percent carbon black and a core of polyethylene terephthalate and the process for the preparation thereof.

BACKGROUND OF THE INVENTION

A geogrid is a manufactured polymer construction characterized by large openings made by either coating woven or knit products to form a grid, welding oriented strands to form a grid, or punching holes in flat sheets then drawing them to align the polymer molecules. Geogrids are used for applications including soil stabilization, drainage, and erosion control. One such application is a subsurface stabilization grid for a highway, for example.

A common technique in the production of highway stabilization geogrids is to use extruded polyolefin film. Polyolefin film refers to film produced from a polymerized olefin such as polypropylene or polyethylene. As an alternative method of forming highway stabilization geogrids, polyethylene terephthalate (PET) fibers can made into a fabric using a warp knit, weft insertion technology. The fabric is then coated with a polyvinyl chloride (PVC) or a latex topcoat containing 2% carbon black for ultraviolet (UV) stabilization. However, there are drawbacks associated with this method. The coating process as it exists can be costly and is perceived as presenting potential environmental problems. The fibers of the grid are susceptible to creep. Therefore, a need exists for an alternative method for forming highway stabilization geogrids.

It is an object of the present invention to provide a geogrid without a topcoat comprised of bicomponent fiber that has improved resistance to creep. Bicomponent fibers, also known as composite fibers, are fibers composed of two or more polymer types in a sheath-core or side-by-side relation. There are sheath-core bicomponent fibers and processes for the making thereof which are known in the art, but they are different from the present invention. For example, in U.S. Pat. No. 4,473,617 only the core of the bicomponent yarn contains a black pigment composed of carbon black particles. It specifically teaches away from black pigment in the sheath because of problems such as great wear of machine parts during the manufacture and processing of the yarn.

U.S. Pat. No. 3,616,183 discloses sheath-core filaments preferably with a polyethylene terephthalate core and a copolyester sheath of ethylene terephthalate/polyoxyethylene terephthalate. After subjecting the sheath-core filaments to a dyeing procedure, a treatment removes the dyestuff from the sheath of the filaments so the lack of dye-fastness and the lack of light resistance normally associated with the presence of dyestuff in the material of which the sheath is composed is no longer a problem.

In addition to the conventional bicomponent fibers, there are several patents directed toward sheath-core composite filaments having highly electrically conductive properties including U.S. Pat. Nos. 4,756,969, 4,085,182, and 5,202,185. However, the prior art does not advocate the presence of conductive carbon black in the sheath, but in fact, teaches against it.

U.S. Pat. No. 4,756,969 discloses an electrically conductive, sheath-core composite filament in which the core and sheath layers are comprised of an electrically non-conductive thermoplastic synthetic polymer, and a middle layer is comprised of electrically conductive thermoplastic synthetic polymer with 15 to 50 percent by weight of carbon black.

U.S. Pat. No. 4,085,182 discloses a process for producing electrically conductive, sheath-core synthetic composite filaments. The core is comprised of a thermoplastic fiber-forming synthetic polymer and electrically conductive carbon black. The concentration of the carbon black in the core is generally 15 to 50 percent by weight, but in order to impart high electric conductivity and retain moderate processability, it is preferably 20 to 35 percent by weight. The sheath is comprised of a thermoplastic fiberforming synthetic polymer that is generally a predominantly linear high molecular weight polymer, capable of forming fibers having superior tenacity and toughness. Examples of such polymers include polyamides, polyesters, and polyolefins.

U.S. Pat. No. 5,202,185 discloses electrically conductive, sheath-core filaments with antistatic properties and methods for the making thereof. The sheath which is composed of a synthetic thermoplastic fiberforming polymer surrounds an electrically conductive, multilobal, polymeric core. The sheath may consist of any extrudable, synthetic, thermoplastic fiberforming polymer or copolymer-polymer including polyolefins such as polyethylenes, polypropylene, polyamides, and polyesters of fiberforming molecular weight. The core is comprised of electrically conductive carbon black in an amount of 20 to 35 percent by weight of the filaments intermixed in polymer. The core polymer may also be selected from the same group as that for the sheath or it may be non-fiberforming since it is protected by the sheath.

A conventional two-layer reverse sheath-core type composite filament with an electrically conductive layer as the sheath and an electrically non-conductive layer as the core presents problems according to U.S. Pat. No. 4,756,969. If carbon black of high concentration is present in the surface layer, carbon black readily falls out during the production processes staining process equipment. According to U.S. Pat. No. 4,756,969, no filament of this type is manufactured in industry. Other problems associated with composite filaments in which an electrically conductive layer is exposed on the filament surface that are mentioned in U.S. Pat. No. 4,756,969 include difficulties in yarn formation or yarn of unsatisfactory quality for industrial production.

SUMMARY OF THE INVENTION

This invention claims a warp knit, weft inserted geogrid fabric without a topcoat, comprising a bicomponent fiber having filaments each with a sheath of a polyolefin material and about 0.5 to about 2 weight percent carbon black and a core of polyethylene terephthalate.

This invention also claims the process for the making thereof comprising the steps of:

(a) providing polyethylene terephthalate with an intrinsic viscosity of at least 0.89 deciliters per gram as determined from a solvent base of orthochlorophenol at 25° C.;

(b) providing an adhesive polyolefin;

(c) passing said polyethylene terephthalate in a molten state into an apparatus for spinning bicomponent sheath-core filaments to form the core of each said filament of a bicomponent fiber;

(d) passing said adhesive polyolefin in a molten state containing about 0.5 weight percent to about 2 weight percent carbon black into said apparatus to form a sheath about said core of each said filament of said bicomponent fiber;

(e) spinning and drawing said bicomponent fiber comprised of filaments each with said sheath of said adhesive polyolefin material and about 0.5 weight percent to about 2 weight percent carbon black and said core of said polyethylene terephthalate;

(f) applying a finish at a level of about 0.4 weight percent to about 0.8 weight percent to said bicomponent fiber;

(g) sizing and warping said bicomponent fiber;

(h) weaving or knitting said bicomponent fiber into a fabric; and (i) bonding said fabric by fusing said sheath using a heating medium.

DESCRIPTION OF THE INVENTION

A bicomponent fiber for a geogrid fabric is prepared by melt extruding polymer from a spinneret in a sheath-core filament configuration. The core of each of the filaments of the bicomponent fiber is polyethylene terephthalate with an intrinsic viscosity of at least 0.89 deciliters per gram as determined from a solvent base of orthochlorophenol at 25° C. An adhesive polyolefin containing carbon black is provided to form the sheath of each of the filaments of the bicomponent fiber. Polyethylene and polypropylene are the preferred polyolefins. More specifically, the polyethylene may be linear low density polyethylene or high density polyethylene. Preferably, the adhesive is maleic anhydride.

The adhesive polyolefin for use in the sheath may be obtained by various means. The polylolefin may be purchased with the desired concentration of adhesive already compounded in it, or the polyolefin may be blended with the adhesive to achieve the desired adhesive concentration as a separate processing step. The same techniques apply for obtaining the desired amount of carbon black in the polyolefin. The preferred amount of carbon black in the polyolefin of the sheath is about 0.5 to about 2 weight percent.

The polymer supply to the melt extruder may be in solid form (i.e., chip) in which case the polymer is melted with the aid of a screw extruder. Alternatively in continuous melt polymerization, the polymer is usually not solidified before spinning. Instead, the product is fed directly through a manifold from the polymerization unit to the spinning unit. Either of these means may be used to provide the polymer supply.

Before reaching the spinneret, the molten polymer is filtered through a series of filtering media. Such media include shattered metal, sintered or fibrous metal gauzes, and fine refractory materials such as sand or alumina.

After filtration, the molten polymer passes to the spinneret. The filter and spinneret are normally mounted in the same assembly known as a pack. Each of the packs has the capability of melt extruding filaments in a sheath-core configuration from a spinneret. A metering gear pump delivers the molten polymer at a constant rate to each of the packs. The sheath polymer and the core polymer are pumped separately into their respective channels in each pack. A pack box which contains the pack(s) also contains a heating element to supply heat to the packs. If there are two packs, bicomponent filaments are extruded through the spinneret holes of each pack to form the bicomponent fiber. Cool filtered air can be blown across the filaments at a controlled rate to encourage uniform cooling (i.e., quench). Once extruded from the spinneret, a finish can be applied to the bicomponent fiber. In continuous filament yarn production, the orientation of the spun yarn depends upon the speed at which it is forwarded or spun. Preferably, the feedroll speed is below about 1500 meters per minute.

The filaments of the fiber are drawn and collected on a bobbin(s) as part of a integrated spin-draw process. If there is more than one pack, the bobbin is the point at which the filaments converge to form a bicomponent fiber yarn. The fiber then passes over a first draw roll. It is preferred that the draw roll is heated as opposed to being at ambient temperature. Preferably, the first draw roll is at about 85° C. After passing over the first draw roll, a steam jet supplies extra heat to the fiber. The extra heat supply is preferred because it avoids operating the second draw roll at a temperature at which the filaments of the fiber would stick to the metal draw roll. Preferably, the second draw roll is at a temperature of about 115° C.

As a modification to the process, the second draw roll can be operated at a temperature ranging from about 118° C. to about 120° C. If the second draw roll operates in that temperature range, the filaments of the fiber bond to each other. This can be advantageous because it eliminates the need to add sizing to the fiber before warp-knitting or weaving. Dimensional stability is increased. Typically, sizing is applied during the warping stage.

The bicomponent fiber is woven or warp-knitted into a fabric using a warp-knit, weft insertion technique. The bicomponent fiber is used as the warp and weft yarns. After the fabric is formed, it is heatbonded as another stage in this continuous process. Preferred methods of heat bonding include radiant heat, calendar rolls, and hot air, among others.

This invention will now be described in greater detail by way of the following non-limiting examples.

EXAMPLE

Bicomponent fiber for a geogrid fabric was prepared by melt-extruding polymer from a spinneret, in a sheath-core filament configuration. Polyethylene terephthalate (PET) was provided with an intrinsic viscosity of at least 0.89 deciliters per gram as determined from a solvent base of orthochlorophenol at 25° C. The PET to be used in the core of the filaments of the bicomponent fiber was extruded. The operating temperatures of the extruder were as follows: 270° C. in zone 1, 275° C. in zone 2, 280° C. in zone 3, 285° C. in the flange, and 290° C. in the manifold.

Linear low density polyethylene (LLDPE) with maleic anhydride adhesive and about 0.5 to about 2 weight percent carbon black was extruded. The temperatures in the extruder were as follows: 150° C. in zone 1, 165° C. in zone 2, 180° C. in zone 3, 250° C. in the flange, and 265° C. in the manifold. A barrier type screw was used in the extruder to improve the dispersion of the carbon black in the LLDPE with adhesive. The molten polymer was then filtered through a bed of shattered metal. The pack box was maintained at 295° C. The pack box contained two packs with each pack containing its own spinneret. The spinneret holes were 0.5 mm in diameter. There were 152 filaments produced per pack for a total of 304 filaments per yarn bundle.

Although two packs were used, one bobbin was used for windup. The bicomponent fiber was taken up at a feedroll speed of 1225 meters per minute. An overall draw ratio of 2.8 was used with a draw split of 1.6. The feedroll was maintained at ambient conditions while the first and second draw rolls were heated to ° C. and 115° C., respectively. A steam jet at 275° C. was utilized to supply additional heat to the fiber between the first and second draw roll. A relax ratio of 5% was used to set the fiber. The fiber's physical properties, produced at the above-mentioned conditions, are shown in Table I.

The bicomponent fiber was warped and then woven using a warp-knit machine. The bicomponent fiber was used in the warp and weft yarns.

TABLE I

| Physical Property Data of the Bicomponent Fiber | |
|---|---|
| denier | 1000 grams |
| tenacity | 7.5 grams/denier |
| elongation | 9.8% |
| 2% strength at specified elongation | 1.65 grams/denier |
| 5% strength at specified elongation | 3.8 grams/denier |
| hot air shrinkage | 21% |
| initial modulus | 94 grams |

The present invention may be embodied in other specific forms without departing from the spirit or essential attributes thereof, and accordingly, reference should be made to the appended claims, rather than to the foregoing specification, as indicating the scope of the invention.

I claim:

1. A heat bonded geogrid fabric comprising a woven or warp knit, weft inserted grid, said fabric comprising a bicomponent fiber with filaments each having a sheath of an adhesive polyolefin material comprising a polyolefin and an adhesive and containing about 0.5 weight percent to about 2 weight percent carbon black and a core of polyethylene terephthalate having an intrinsic viscosity of at least 0.89 deciliters per gram as determined from a solvent base of orthochlorophenol at 25° C.

2. A heat bonded geogrid fabric of claim 1 wherein said polyolefin is polyethylene or polypropylene.

3. A heat bonded geogrid fabric of claim 1 wherein said adhesive is maleic anhydride.

4. A heat bonded geogrid fabric according to claim 2 wherein the adhesive is maleic anhydride.

5. A heat bonded geogrid fabric according to claim 4 wherein the polyolefin is linear low density polyethylene.

6. A heat bonded geogrid fabric according to claim 2 wherein the polyolefin is linear low density polyethylene or high density polyethylene.

7. A heat bonded geogrid fabric according to claim 6 wherein the polyolefin is linear low density polyethylene.

* * * * *